US007331323B2

(12) United States Patent
Hara

(10) Patent No.: US 7,331,323 B2
(45) Date of Patent: Feb. 19, 2008

(54) LUBRICATING OIL SUPPLYING SYSTEM FOR INTERNAL COMBUSTION ENGINE

(75) Inventor: Seinosuke Hara, Kanagawa (JP)

(73) Assignee: Hitachi, Ltd., Tokyo (JP)

( * ) Notice: Subject to any disclaimer, the term of this patent is extended or adjusted under 35 U.S.C. 154(b) by 178 days.

(21) Appl. No.: 11/240,834

(22) Filed: Oct. 3, 2005

(65) Prior Publication Data

US 2006/0070600 A1 Apr. 6, 2006

(30) Foreign Application Priority Data

Oct. 6, 2004 (JP) ..... 2004-293504

(51) Int. Cl.
*F01M 3/04* (2006.01)
*F01M 1/04* (2006.01)
*F16K 24/00* (2006.01)

(52) U.S. Cl. ..... 123/196 A; 123/196 AB; 137/493.3; 137/493.6; 184/6.5

(58) Field of Classification Search ..... 123/198 R, 123/196 A, 196 AB, 41.2, 41.22; 184/6.5, 184/6.23; 137/493.6, 493.3
See application file for complete search history.

(56) References Cited

U.S. PATENT DOCUMENTS 523,958 A * 7/1894 Bumpers ..... 415/69
3,861,414 A * 1/1975 Peterson, II ..... 137/512.3
4,512,298 A * 4/1985 Hayashi ..... 123/196 R
4,834,134 A * 5/1989 Asami et al. ..... 137/493.3
4,962,829 A * 10/1990 Sugden ..... 184/6.23
5,584,650 A * 12/1996 Redmond et al. ..... 415/55.5
5,950,669 A * 9/1999 Fehlmann et al. ..... 137/493.3
6,293,253 B1 * 9/2001 Arnold et al. ..... 123/458
6,408,871 B1 * 6/2002 Ryerson et al. ..... 137/493
6,647,965 B1 * 11/2003 Breeden ..... 123/446
6,719,005 B1 * 4/2004 Trimble et al. ..... 137/493.6
6,786,183 B2 * 9/2004 Hoelle et al. ..... 123/41.44
7,048,521 B2 * 5/2006 Kondo ..... 417/443

FOREIGN PATENT DOCUMENTS

JP 2001-214765 A 8/2001
JP 2003-148120 A 5/2003

* cited by examiner

*Primary Examiner*—Stephen K. Cronin
(74) *Attorney, Agent, or Firm*—Foley & Lardner LLP

(57) ABSTRACT

A lubricating oil supplying system for an internal combustion engine includes a lubricating oil storage section for storing lubricating oil. A driven pump is driven by the internal combustion engine to suck the lubricating oil from the lubricating oil storage section and discharge the lubricating oil to a discharge passage. An electric pump is provided for sucking the lubricating oil discharged from the driven pump to the discharge passage and discharge the lubricating oil to a lubricating oil requiring section in the internal combustion engine. A controlling mechanism is provided for drivingly controlling the electric pump in accordance with a control signal. A bypass passage is provided for bypassing the driven pump. A check valve is disposed in the bypass passage to allow the lubricating oil in the lubricating oil storage section to flow only through a path bypassing the driven pump and toward the discharge passage.

26 Claims, 4 Drawing Sheets

LUBRICATING OIL SUPPLYING SYSTEM FOR INTERNAL COMBUSTION ENGINE

BACKGROUND OF THE INVENTION

This invention relates to improvements in a lubricating oil supplying system for an internal combustion engine, arranged to supply lubricating oil to various sliding sections, a variable valve actuation mechanism or the like in the internal combustion engine under the action of an oil pump driven by the internal combustion engine and an electric pump driven by an electric motor.

Hitherto, various types of the lubricating oil supplying systems were proposed and put into practical use. One of such lubricating oil supplying apparatuses is disclosed in a Japanese Patent Provisional Publication No. 2003-148120. Briefly, this lubricating oil supplying system includes a variable valve actuation mechanism serving as a driving device, disposed to the main body of an internal combustion engine. The variable valve actuation mechanism and various sliding sections are supplied with lubricating oil stored in a lubricating oil tank. The lubricating oil stored within the lubricating oil tank is sucked and supplied to the main body of the internal combustion engine, under the action of a driven pump driven by the internal combustion engine.

The lubricating oil supplying system further includes a heat accumulative container which is in communication with the discharge side of the driven pump and stores therein the lubricating oil discharged from the driven pump, warming the lubricating oil. The lubricating oil within the heat accumulative container is sucked and supplied to the variable valve actuation mechanism under the action of an electric pump disposed separate from the driven pump. Consequently, the electric pump and various opening-closing valves are driven through a control means in accordance with a prediction result of a starting prediction means for the internal combustion engine, thereby supplying the lubricating oil, which has been previously heated before the starting of the internal combustion engine, to the variable valve actuation mechanism so as to improve a driving response of the engine.

SUMMARY OF THE INVENTION

In the above-described conventional lubricating oil supplying system, the electric pump is disposed at the downstream side of the driven pump and located in series with the driven pump through the heat accumulative container, so that the lubricating oil sucked in and discharged from the driven pump is directly sent to the electric pump. Consequently, it is not required that each pump separately sucks lubricating oil from the lubricating oil tank. As a result, there is a merit to simplifying the hydraulic circuit. However, if the amount of the lubricating oil discharged from the electric pump exceeds that from the driven pump, a negative pressure is developed between these pumps. In view of this, a check valve is provided to the heat accumulative container to introduce a low pressure therein, so that negative pressure can be prevented from being developed.

However, during opening of the check valve, the lubricating oil is supplied into the heat accumulative container through a hydraulic passage formed separate from the above configuration in order to fill the heat accumulative container with the lubricating oil. This hydraulic passage must be formed relatively long, making the structure of oil pressure passages complicated. As a result, manufacturing or production operation for the lubricating oil supplying system becomes troublesome so that production cost unavoidably rises.

It is an object of the present invention is to provide an improved lubricating oil supplying system for an internal combustion engine which can effectively overcome drawbacks encountered in conventional lubricating oil supplying systems for the internal combustion engine.

Another object of the present invention is to provide an improved lubricating oil supplying system for the internal combustion engine, in which a negative pressure can be prevented from being developed between a driven pump and an electric pump for the lubricating oil supply, while avoiding a complex passage structure for the lubricating oil thereby controlling production cost.

An aspect of the present invention resides in a lubricating oil supplying system for an internal combustion engine, which includes a lubricating oil storage section for storing lubricating oil. A driven pump is driven by the internal combustion engine to suck the lubricating oil from the lubricating oil storage section and discharge the lubricating oil to a discharge passage. An electric pump is provided for sucking the lubricating oil discharged from the driven pump to the discharge passage and discharging the lubricating oil to a lubricating oil requiring section in the internal combustion engine. A controlling mechanism is provided for drivingly controlling the electric pump in accordance with a control signal. A bypass passage is provided for bypassing the driven pump. A check valve is disposed in the bypass passage to allow the lubricating oil in the lubricating oil storage section to flow only through a path bypassing said driven pump and toward the discharge passage.

With the above arrangement, when the amount of lubricating oil discharged from the electric pump exceeds that from the driven pump, the lubricating oil within the lubricating oil storage section flows from the inlet of the bypass passage through the check valve into the discharge passage. Then, the lubricating oil is sucked in and discharged from the electric pump so as to be supplied to the lubricating oil requiring section. By this, a negative pressure between the two pumps can be prevented. Also, the passage structure for the lubricating oil is simple and cost-efficient because only a short bypass passage for merely bypassing the driven pump is provided.

Another aspect of the present invention resides in a fluid pump, which includes a pump mechanism for sucking fluid from a storage section and discharging the fluid to a discharge section. A plunger valve body has a pressure receiving section which is formed at one end of the plunger valve body and opens to the discharge section. The plunger valve body is movable to release a part of fluid discharged from the pump mechanism to the discharge section to a low pressure section. A section defining a low pressure chamber is formed at the other end of the plunger valve body and in communication with the low pressure section. A biasing member is disposed in the low pressure chamber to bias the plunger valve body in one direction. A check valve is disposed in the pressure receiving section of the plunger valve body to allow the lubricating oil to flow through a path from the lower pressure chamber to the discharge section.

A further aspect of the present invention resides in a lubricating oil supplying system for an internal combustion engine, which includes a lubricating oil storage section for storing lubricating oil. A first pump is provided for sucking the lubricating oil from the lubricating oil storage section and discharging the lubricating oil to a discharge passage. A second pump is provided for sucking the lubricating oil discharged from the first pump to the discharge passage and discharging the lubricating oil to a lubricating oil requiring section in the internal combustion engine. A bypass passage is provided for bypassing the first pump. An opening and closing mechanism is disposed in the bypass passage to open the bypass passage when an amount of the lubricating oil discharged from the second pump exceeds that from the first pump, and to cut off the bypass passage when the amount of the lubricating oil discharged from the first pump is similar to that from the second pump or when the amount of the lubricating oil discharged from the second pump is lower than that from the first pump.

The other objects and features of this invention will become understood from the following description with reference to the accompanying drawings.

BRIEF DESCRIPTION OF THE DRAWINGS

In the drawings, like reference numerals designate like parts and elements throughout all figures in which.

DETAILED DESCRIPTION OF THE INVENTION

Figure 1:
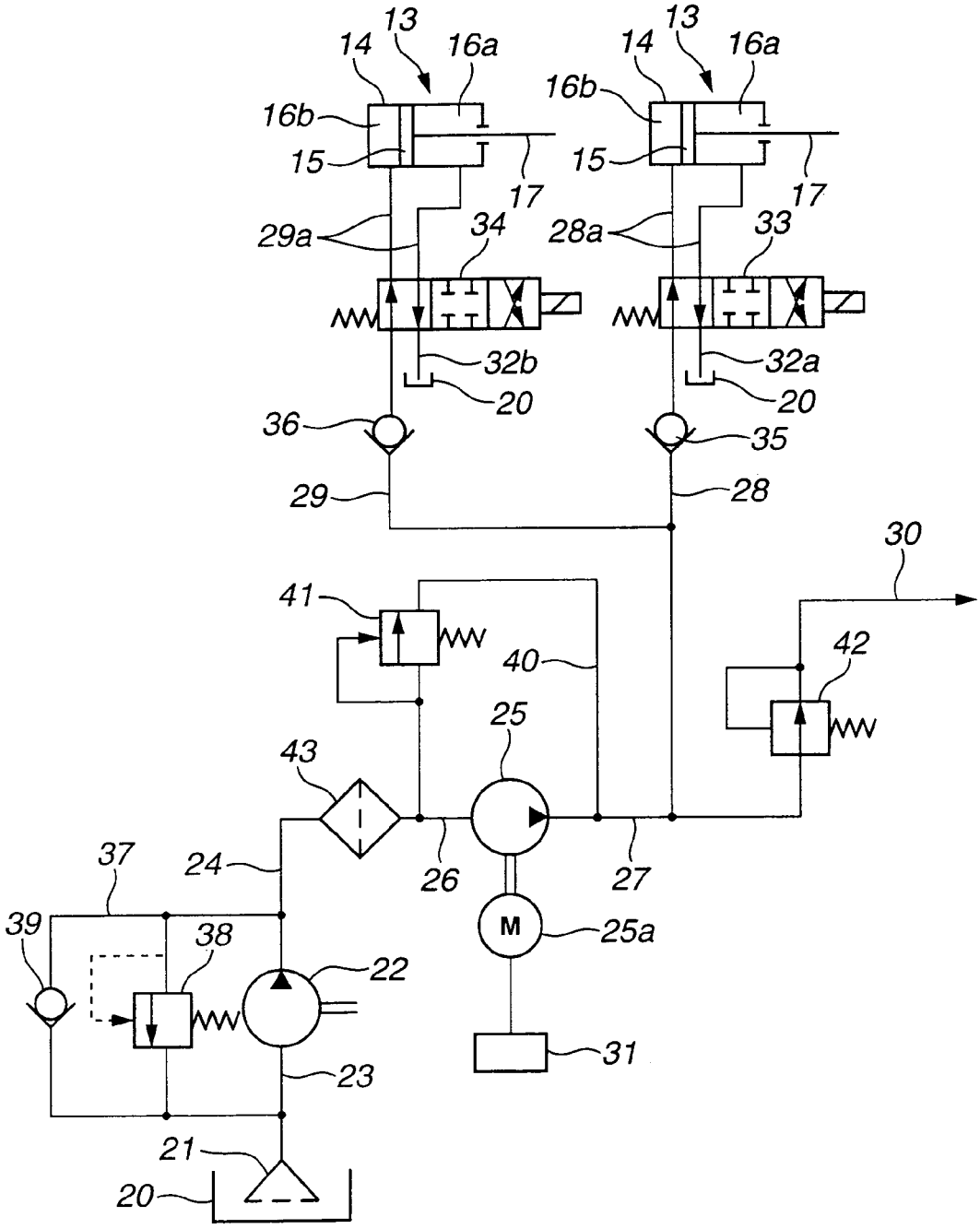
FIG. 1 is a diagrammatic illustration of an oil pressure circuit of an embodiment of a lubricating oil supplying system according to the present invention.
Figure 2:
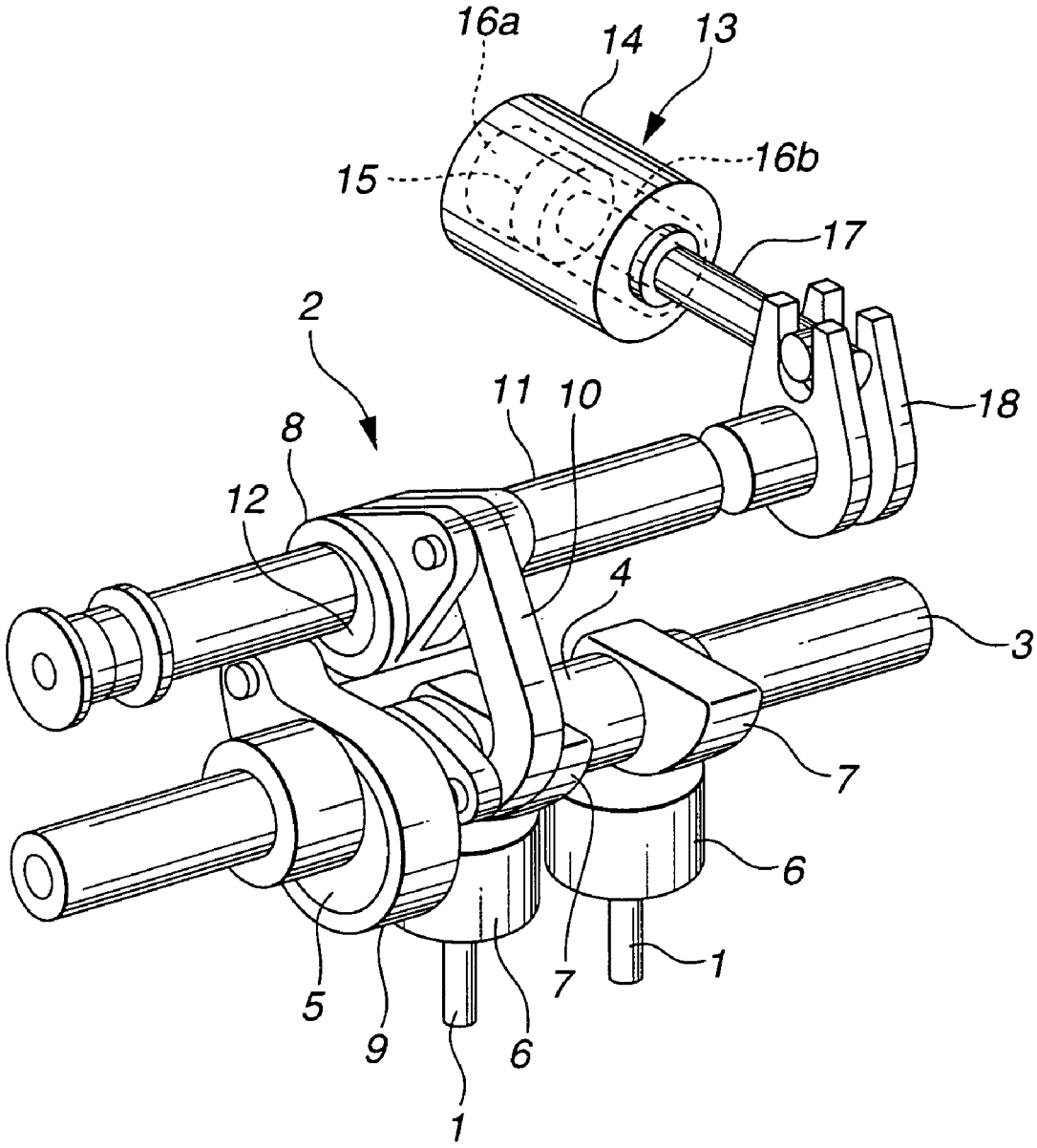
FIG. 2 is a perspective view of a variable valve actuation mechanism used in the system of FIG. 1.

Referring now to FIGS. 1 to 5, an embodiment of a lubricating oil supplying system for an internal combustion engine, according to the present invention is illustrated. Firstly, the internal combustion engine is a multi-cylinder V-type engine, in which two intake valves 1, 1 are provided for each (engine) cylinder so as to be slidably supported by a cylinder head (not shown). The valve lift of each of the intake valves 1, 1 is variably controlled in accordance with an engine operating condition under the action of a variable valve lift mechanism 2, as shown in FIG. 2.

This variable valve lift mechanism 2 is the same as that disclosed in Japanese Patent Provisional Publication No. 2001-214765 whose assignee is the same as that in the present application, so that explanation thereof will be briefly made. Japanese Patent Provisional Publication No. 2001-214765 is incorporated herein by reference. In the variable valve lift mechanism 2, driving shaft 3 whose inside is hollow is arranged at the side of each cylinder bank of the engine to extend in the fore-and-aft direction of the engine. Cam shaft 4 is provided for each cylinder in such a manner as to be movably supported around the outer peripheral surface of driving shaft 3 and coaxial with driving shaft 3. Driving cam 5 is fixedly disposed at a certain position on driving shaft 3 and provided for each cylinder. A pair of swingable cams 7, 7 are fixed to cam shaft 4 at opposite end sections and slidably contacted with valve lifters 6, 6 which are respectively disposed at upper end sections of intake valves 1, 1, so as to cause opening action of intake valves 1, 1. Locker arm 8 links driving cam 5 to swingable cam 7 and serves as a transmission means for transmitting torque of driving cam 5 as swingable force (or valve opening force) to swingable cams 7, 7. Link arm 9 mechanically links one end of locker arm 8 to the driving cam 5. Link rod 10 mechanically links the other end of locker arm 8 to the swingable cam 7. A control means is provided to control the operational position of the transmission means.

The control means includes control shaft 11 which is movably supported above driving shaft 3. Control cam 12 is fixed, as a single member, on control shaft 11 at its outer peripheral surface so as to serve as a swingable supporting section of locker arm 8. Control shaft 11 is rotatably controlled by hydraulic actuator 13 within a certain rotational angle range.

Hydraulic actuator 13 includes hydraulic cylinder 14 installed to an end wall of the cylinder head (not shown) through a bracket (not shown). Piston 15 is slidably disposed in hydraulic cylinder 14 to divide the interior of hydraulic cylinder 14 into two hydraulic chambers 16*a*, 16*b*. Piston rod 17 has its one end section fixed with piston 15, and the other end section linked with control shaft 11 through linking arm 18. Oil pressure is supplied to or released from the lubricating oil supplying system selectively into hydraulic chambers 16*a*, 16*b*.

As shown in FIG. 1, the lubricating oil supplying system includes oil pan 20 (or a low pressure section) as a lubricating oil storage section at a low pressure side, installed at a lower end section of the cylinder block (not shown) of the internal combustion engine in order to store lubricating oil (or hydraulic fluid). One-way oil pump 22 as a driven pump is rotationally driven by a crankshaft (not shown), and sucks the lubricating oil from oil pan 20 through strainer 21 and suction passage 23. One-way electric pump 25 is connected in series with oil pump 22, and sucks the lubricating oil discharged through oil pump 22 to discharge passage 24 (or a discharge section) directly via second suction passage 26 and discharges the lubricating oil to second discharge passage 27. The lubricating oil discharged from electric pump 25 through second discharge passage 27 is supplied through oil pressure supplying passages 28, 29 into hydraulic chambers 16*a*, 16*b* of each hydraulic actuators 13, and is also supplied through main oil gallery 30 to various sliding sections or lubricating oil requiring sections in the engine.

Figure 3:
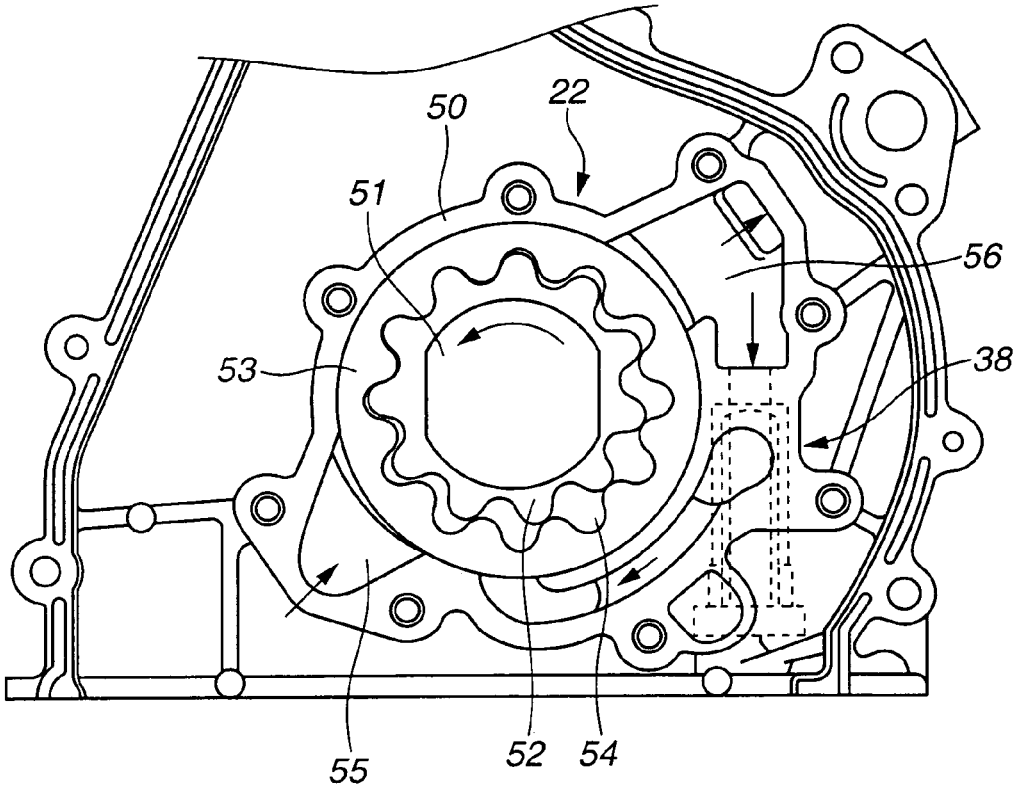
FIG. 3 is a front view of an oil pump used in the system of FIG. 1.

As shown in FIG. 3, oil pump 22 is of a general trochoid type and includes pump housing 50 fixed to a side wall of the cylinder block (not shown) of the engine. Pump housing 50 accommodates therein inner rotor 52 which is rotatably driven through pump shaft 51 which is rotatably driven by the crank shaft. Outer rotor 53 is rotatably disposed inside pump housing 50 and has internal teeth which are engageable with external teeth of inner rotor 52. Pump chamber 54 is defined between each internal tooth and each external tooth, corresponding to one internal or external tooth. The volume of pump chamber 54 varies to cause pumping action. Pump housing 50 is formed at its lower end section with suction port 55 in communication with suction passage 23 and at its upper end section with discharge port 56 in communication with discharge passage 24. Relief valve 38 is disposed at a lower section of discharge port 56 and will be discussed below.

Regarding electric pump 25, electric motor 25*a* is rotatably controlled in accordance with an engine operating condition under the action of controller 31 as a controlling mechanism.

Oil pressure supplying passages 28, 29 are respectively connected with supplying-draining passages 28*a*, 29*a* through which oil pressure is supplied to or released from hydraulic chambers 16*a*, 16*b*. Additionally, drain passages 32*a*, 32*b* are provided to release oil pressure from hydraulic chambers 16*a*, 16*b*. Supplying-draining passages 28*a*, 29*a* and drain passages 32*a*, 32*b* are selected under the action of electromagnetic selector valves 33, 34 which are respectively disposed in oil pressure supplying passages 28, 29. Oil pressure supplying passages 28, 29 respectively have check valves 35, 36 which prevent reverse flow of the lubricating oil from hydraulic chambers 16*a*, 16*b* and are respectively disposed at the upstream sides of electromagnetic selector valves 33, 34. Electromagnetic selector valves 33, 34 are arranged to carry out operation for selecting the passages through spool valves disposed therein under the action of a control current from controller 31.

First bypass passage 37 is provided at the side of oil pump 22 so as to bypass oil pump 22. More specifically, this first bypass passage 37 has an upstream end connected with suction passage 23 and a downstream end connected with discharge passage 24, so that first bypass passage 37 is disposed to bypass oil pump 22. Relief valve 38 is connected to first bypass passage 37 in parallel with oil pump 22 to regulate pressure of the lubricating oil discharged from oil pump 22 to discharge passage 24 at a constant level. Check valve 39 is disposed at a position in parallel with relief valve 38 to allow the lubricating oil to flow only in a direction of from the side of suction passage 23 to the side of discharge passage 24 in first bypass passage 37.

On the other hand, second bypass passage 40 is formed at the side of electric pump 25 so as to bypass electric pump 25. More specifically, this second bypass passage 40 has an upstream end connected with second suction passage 26 and a downstream end connected with second discharge passage 27, so that second bypass passage 40 is disposed to bypass electric pump 25. Bypass valve 41 is disposed in second bypass passage 40 to be opened when electric pump 25 stops operating. This bypass valve 41 is adapted to open at a lower pressure level than the pressure level at which relief valve 38 opens.

Pilot pressure reducing valve 42 (or pressure reducing valve) is disposed at the downstream side of second discharge passage 27 connected with electric pump 25 to reduce the pressure of the lubricating oil discharged to main oil gallery 30 at a constant level.

Filter 43 is disposed between discharge passage 24 and second suction passage 26. Electric pump 25, second bypass passage 40, bypass valve 41, and pilot pressure reducing valve 42 are fixedly installed to the cylinder block in such a manner as to be connected with main oil gallery 30.

Information or signals from various types of sensors such as an engine speed sensor, an intake air amount sensor, a throttle valve opening degree sensor, an engine coolant temperature sensor, or the like (not shown) are fed into controller 31 so as to detect the engine operating condition at present time upon calculation or the like in controller 31. Subsequently, controller 31 produces the control currents in accordance with the engine operating condition which control currents are output to electric motor 25*a* and electromagnetic selector valves 33, 34.

Hereinafter, discussion will be made on operation of this embodiment. At engine starting, the lubricating oil is low in temperature and high in viscosity. This increases flow resistance in an oil passage and decreases the number of rotations of oil pump 22 thereby lowering oil pressure supplied to various sections of the engine. Consequently, electric motor 25*a* is rotationally driven under the action of the control current from controller 31 thereby rotatably driving electric pump 25. At this time, controller 31 does not apply current to electromagnetic selector valves 33, 34 so that these valves are in an open state.

Therefore, the lubricating oil discharged from both pumps 22, 25, is smoothly increased in oil pressure and supplied through oil pressure supplying passages 28, 29 to hydraulic chambers 16*a*, 16*b*, and additionally, through main oil gallery 30 to the various sliding sections in the engine.

More specifically, each hydraulic actuator 13 is supplied with oil pressure so as to be able to be driven in accordance with a command current from controller 31. By this, variable valve lift mechanism 2 can be optimally controlled in accordance with the engine operating condition immediately after the engine starts. Therefore, for example, in case rapid acceleration is demanded immediately after engine starting, it is possible to obtain a good acceleration characteristic upon control of variable valve lift mechanism 2 to a certain valve lift.

Thereafter, when engine speed rises so that the temperature of the lubricating oil is raised thereby making a shift to a normal operating range, the discharge pressure of the lubricating oil discharged under the action of oil pump 22 becomes sufficiently high. Then, controller 31 cuts off electric current supplied to electric motor 25*a* so that electric pump 25 stops operating. On the other hand, electric current is supplied to electromagnetic selector valves 33, 34 so as to move each spool valve inside electromagnetic selector valves 33, 34. This opens oil pressure supplying passages 28, 29 and drain passages 32*a*, 32*b* so that oil pressure is supplied to one-side hydraulic chambers 16*b*, 16*b* while the lubricating oil within the other-side hydraulic chambers 16*a*, 16*a* is discharged through drain passages 32*a*, 32*b* into oil pan 20. As a result, each piston rod 17 is moved by a certain amount thereby rotationally driving each control shaft 11 by a certain degree in angle. By this, variable valve lift mechanism 2 controls the valve lift amount of intake valves 1, 1 in a manner to gradually increase the valve lift amount.

In case that the engine speed rises thereby changing engine speed to a high speed range, a large amount of the lubricating oil is supplied into each hydraulic chamber 16*b*, 16*b* through electromagnetic selector valves 33, 34 operated by controller 31, while the lubricating oil is drained from each hydraulic chamber 16*a*, 16*a*. By this, control shaft 11 is rotated the maximum in one direction so that variable valve lift mechanism 2 controls the valve lift of intake valves 1, 1 to the maximum valve lift amount.

On the other hand, in case that the engine speed changes from a high speed range to lower or medium speed range, electromagnetic selector valves 33, 34 are operated to reverse the flow. At this time, oil pressure is supplied to hydraulic chambers 16*a*, 16*a*, while oil pressure within hydraulic chambers 16*b*, 16*b* is released through drain passages 32*a*, 32*b*. By this, each piston 15 moves back so as to rotate control shaft 11 in an opposite direction. Therefore, variable valve lift mechanism 2 controls the valve lift of intake valves 1, 1 in a manner to gradually decrease to a small valve lift amount.

In this embodiment, in case that both oil pump 22 and electric pump 25 are driven so that the lubricating oil discharged through oil pump 22 is sucked in and discharged through electric pump 25, when the amount of the lubricating oil discharged by electric pump 25 exceeds the amount discharged by oil pump 22, the lubricating oil within oil pan 20 is automatically drawn through the upstream end of bypass passage 37 and check valve 39 into the side of discharge passage 24 and second suction passage 26, and then sucked in and discharged by electric pump 25.

As a result, in addition to securely preventing generation of negative pressure between both pumps 22 and 25 or between discharge passage 24 and second suction passage 26, the structure of passages for the lubricating oil is simplified and kept economical because only short bypass passage 37 for merely bypassing oil pump 22 is provided.

In case that pressure of the lubricating oil passed through oil pump 22 or bypass passage 37 exceeds a certain level within discharge passage 24, relief valve 38 opens so as to allow the lubricating oil to flow into oil pan 20. As a result, an excessively high pressure can be prevented from being generated within discharge passage 24.

As discussed above, in case electric pump 25 stops operating under the action of controller 31, the lubricating oil discharged through oil pump 22 can be supplied from discharge passage 24 through second bypass passage 40, bypass valve 41 and main oil gallery 30 to the various sliding sections, without increasing a driving load of oil pump 22. Additionally, the lubricating oil can be supplied also through oil pressure supplying passages 28, 29 to hydraulic chambers 16*a*, 16*b*. As a result, it is possible to secure good lubrication in the various sliding sections and good control response in variable valve lift mechanism 2.

Furthermore, pilot pressure reducing valve 42 is disposed at the downstream side of second discharge passage 27 so that the pressure of the lubricating oil being supplied to the various sliding sections and hydraulic chambers 16*a*, 16*b* is not excessively high.

Figure 4:
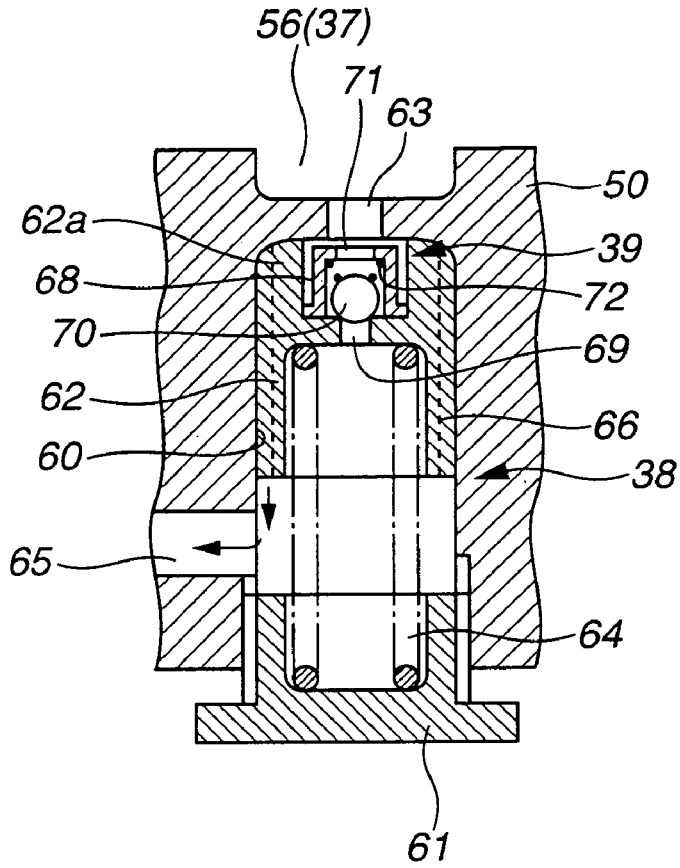
FIG. 4 is a vertical cross-sectional view of an assembly arrangement including a relief valve and a check valve in another embodiment of the lubricating oil supplying system according to the present invention.
Figure 5:
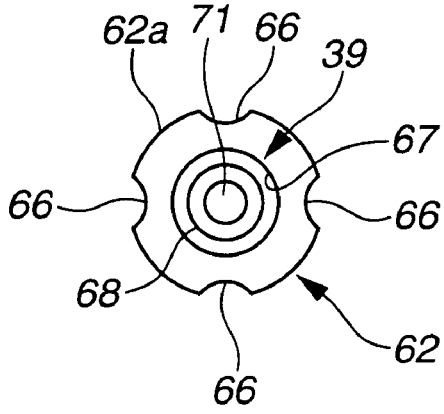
FIG. 5 is a plan view of a plunger valve body used in the relief valve of FIG. 4.

FIGS. 4 and 5 illustrate another embodiment of the lubricating oil supplying system according to the present invention, similar to the embodiment of FIGS. 1 to 3, with the exception that check valve 39 is assembled within relief valve 38 disposed to bypass passage 37.

More specifically, relief valve 38 is formed with cylindrical retaining hole 60 (or a low pressure chamber in bypass passage 37) located at the inside of pump housing 50 and at the side of discharge port 56. Plunger valve body 62 is slidably disposed inside retaining hole 60 whose bottom section is closed with plug member 61. Pump housing 50 is formed with pressure receiving chamber 63 located at a section above the tip end of retaining hole 60. Pressure receiving chamber 63 is in communication with discharge port 56 so as to be opened and closed with a surface of top section 62*a* of plunger valve body 62. Valve spring 64 is a biasing member that is retained between plunger valve body 62 and plug member 61 so as to bias plunger valve body 62 in a direction to close pressure receiving chamber 63.

Retaining hole 60 has a lower section which is in communication with a downstream side (within oil pan 20) of bypass passage 37 through communicating passage 65.

Additionally, as shown also in FIG. 5, plunger valve body 62 is formed with four communicating grooves 66 extending in an axial direction of plunger valve body 62 and located at the outer peripheral surface thereof at intervals of about 90 degrees (in angle) in the peripheral direction of plunger valve body 62. Each communication groove 66 has a bottom surface of arcuate shape in section. Consequently, when plunger valve body 62 is moved down against the biasing force of valve spring 64, the lubricating oil within pressure receiving chamber 63 flows from the top surface of top section 62*a* through each communicating groove 66 to communicating passage 65, thereby being returned to the downstream side of bypass passage 37.

Furthermore, check valve 39 is accommodated and disposed inside top section 62*a* of plunger valve body 62.

This check valve 39 includes cup-shaped retainer 68 which is press-fitted within valve hole 67 formed at the central portion of top section 62*a*. Retainer 68 accommodates and retains therein check ball 70 for opening and closing communicating hole 69 formed through the bottom wall of valve hole 67. Retainer 68 is formed with through-hole 71 which is formed through the central portion of the upper wall so as to be in communication with pressure receiving chamber 63. Check ball 70 is biased in a direction to close communicating hole 69 by spring 72 (i.e., another biasing member) which has a sufficiently small spring force and is retained between check ball 70 and the upper wall of retainer 68.

When the pressure of the lubricating oil discharged from oil pump 22 exceeds a certain level, the lubricating oil flows through discharge port 56 into pressure receiving chamber 63 thereby pushing down plunger valve body 62 against the biasing force of valve spring 64. By this, the lubricating oil within pressure receiving chamber 63 flows through each communicating groove 66 into retaining hole 60 and then flows through communicating passage 65 to be drained into oil pan 20.

As a result, an excessive pressure rise at the side of discharge passage 24 can be suppressed as discussed above.

Additionally, under this condition, communicating hole 69 can be securely closed with check ball 70 under the action of oil pressure within pressure receiving chamber 63 and transmitted through through-hole 71 and of the biasing force of spring 72.

On the other hand, when the pressure of the lubricating oil discharged from electric pump 25 exceeds that from oil pump 22, the lubricating oil flows from bypass passage 37 through communicating passage 65 into retaining hole 60. This lubricating oil raises check ball 70 against the biasing force of spring 72 thereby opening communicating hole 69.

As a result, the lubricating oil within oil pan 20 flows through bypass passage 37 and check valve 39 into discharge passage 24 and second suction passage 26 thereby being sucked to and discharged from electric pump 25. Consequently, a negative pressure can be securely prevented from being generated between both pumps 22, 25.

Moreover, since check valve 39 is assembled inside relief valve 38, it is unnecessary to form a special oil passage for disposing therein check valve 39. As a result, it becomes possible to further simplify the passage configuration and to reduce the production cost.

Hereinafter, discussion will be made on technical ideas comprehended from the above embodiments.

(1) Disclosed herein is a lubricating oil supplying system for an internal combustion engine, which includes a lubricating oil storage section for storing lubricating oil. A driven pump is driven by the internal combustion engine to suck the lubricating oil from the lubricating oil storage section and discharge the lubricating oil to a discharge passage. An electric pump is provided for sucking the lubricating oil discharged from the driven pump to the discharge passage and discharge the lubricating oil to a lubricating oil requiring section in the internal combustion engine. A controlling mechanism is provided for drivingly controlling the electric pump in accordance with a control signal. A bypass passage is provided for bypassing the driven pump. A check valve is disposed in the bypass passage to allow the lubricating oil in the lubricating oil storage section to flow only through a path bypassing said driven pump and toward the discharge passage.

With the above arrangement, when an amount of the lubricating oil discharged from the electric pump exceeds that from the driven pump, the lubricating oil within the lubricating oil storage section flows from the inlet of the bypass passage through the check valve into the discharge passage. Then, the lubricating oil is sucked in and discharged from the electric pump so as to be supplied to the lubricating oil requiring section. By this, a negative pressure between the two pumps can be prevented. Also, the passage structure for the lubricating oil is simple and cost-efficient because only a short bypass passage for merely bypassing the driven pump is provided.

(2) In the technical idea of (1) above, the lubricating oil supplying system for an internal combustion engine further includes a relief valve disposed in the bypass passage to allow the lubricating oil within the discharge passage to flow to the lower pressure side when the discharge pressure of the lubricating oil discharged from the driven pump to the discharge passage exceeds a certain level.

With the above arrangement, when the pressure within the discharge passage exceeds the certain level, the relief valve opens to allow the lubricating oil to flow to the lower pressure side, so that an excessively high pressure can be prevented from being developed within the discharge passage.

(3) In the technical idea of (2) above, the lubricating oil flowing out through the relief valve is returned to the lubricating oil storage section at the lower pressure side. The check valve may be disposed inside the relief valve to allow the lubricating oil to flow only through a path from the lubricating oil storage section to the discharge passage.

With the above arrangement, the lubricating oil returned through the relief valve into the lubricating oil storage section can again flow into the discharge passage when the check valve opens. Additionally, if the check valve is assembled inside the relief valve, it is unnecessary to provide a special oil passage to which the check valve is to be disposed. As a result, it is possible to simplify the passage configuration and to achieve a cost reduction.

(4) In the technical idea of (3) above, the relief valve includes a plunger valve body having a pressure receiving section formed at one end of the plunger valve body. A section defining a lower pressure chamber is formed at the other end of the plunger valve body to be in communication with the lubricating oil storage section. A biasing member is disposed in the lower pressure chamber to bias the plunger valve body in one direction. A part of the lubricating oil acting on the pressure receiving section flows through the lower pressure chamber into the lubricating oil storage section when the plunger valve body moves against the biasing force of the biasing member. The check valve is disposed in the pressure receiving section of the relief valve.

(5) In the technical idea of (2) above, the lubricating oil supplying system for an internal combustion engine further includes a second bypass passage for bypassing the electric pump. A bypass valve is disposed in the second bypass passage and is adapted to open in accordance with the pressure in the discharge passage. The bypass valve is adapted to open at a pressure level lower than the pressure level at which the relief valve opens.

According to this idea, no lubricating oil is released to the lower pressure side when the lubricating oil is supplied through the bypass valve to the lubricating oil requiring section. Therefore, wasteful operation of the electric pump can be prevented.

(6) In the technical idea of (1) above, the lubricating oil supplying system for an internal combustion engine further includes a second bypass passage for bypassing the electric pump. A bypass valve is disposed in the second bypass passage and is adapted to open in accordance with the pressure level in the discharge passage.

According to this idea, the lubricating oil discharged from the driven pump can be supplied from the discharge passage through the second bypass passage to the lubricating oil requiring section without increasing a driving load of the driven pump, even in the case that the electric pump is not operating.

(7) In the technical idea of (1) above, the lubricating oil supplying system for an internal combustion engine further includes a second bypass passage for bypassing the electric pump. A bypass valve is disposed in the second bypass passage and is adapted to open when the electric pump stops operating.

According to this idea, operational effects similar those in (6) above can be obtained.

(8) In the technical idea of (1) above, the lubricating oil supplying system for an internal combustion engine further includes a pressure reducing valve for reducing the pressure of the lubricating oil supplied to the lubricating oil requiring section when the pressure in the section from the electric pump to the lubricating oil requiring section exceeds a certain level.

According to this idea, the lubricating oil at a high pressure exceeding a required level can be prevented from being supplied to the lubricating oil requiring section, under the action of the pressure reducing valve.

(9) In the technical idea of (1) above, the lubricating oil requiring section includes a main oil gallery for supplying the lubricating oil to sliding sections in the internal combustion engine, and a variable valve actuation mechanism operated by oil pressure. The electric pump is driven by the controlling mechanism in accordance with an operating condition of the variable valve actuation mechanism.

It will be understood that this invention is not limited to the configurations in the above embodiments. For example, the driven pump may be a vane type in place of the above trochoid type. Additionally, one of the lubricating oil requiring sections may be a driving apparatus such as a valve timing controlling mechanism (variable valve timing mechanism) or the like controlled by oil pressure, and/or variable valve lift mechanism 2. Moreover, the operating periods of electric pump 25 are not limited to discrete periods, so that it is possible to drive electric pump 25 separately, for example, in case oil pump 22 should fail.

The entire contents of Japanese Patent Application No. 2004-293504, filed Oct. 6, 2004 is incorporated herein by reference.

What is claimed is:

1. A lubricating oil supplying system for an internal combustion engine, comprising:

a lubricating oil storage section for storing lubricating oil;

a driven pump driven by the internal combustion engine to suck the lubricating oil from said lubricating oil storage section and discharge the lubricating oil to a discharge passage;

an electric pump for sucking the lubricating oil discharged from said driven pump to the discharge passage and discharge the lubricating oil to a lubricating oil requiring section in the internal combustion engine;

a controlling mechanism for drivingly controlling said electric pump in accordance with a control signal;

a bypass passage for bypassing said driven pump; and a check valve disposed in said bypass passage to allow the lubricating oil in the lubricating oil storage section to flow only through a path bypassing said driven pump and toward the discharge passage.

2. A lubricating oil supplying system for an internal combustion engine, as claimed in claim 1, further comprising a second bypass passage for bypassing said electric pump, and a bypass valve disposed in the second bypass passage and adapted to open in accordance with the pressure level in the discharge passage.

3. A lubricating oil supplying system for an internal combustion engine, as claimed in claim 1, further comprising a second bypass passage for bypassing said electric pump, and a bypass valve disposed in the second bypass passage and adapted to open when said electric pump stops operating.

4. A lubricating oil supplying system for an internal combustion engine, as claimed in claim 1, further comprising a pressure reducing valve for reducing the pressure of the lubricating oil supplied to the lubricating oil requiring section when the pressure in the section between said electric pump and the lubricating oil requiring section exceeds a predetermined level.

5. A lubricating oil supplying system for an internal combustion engine, as claimed in claim 1, further comprising a filter disposed between said driven pump and said electric pump.

6. A lubricating oil supplying system for an internal combustion engine, as claimed in claim 1, wherein said electric pump stops operating when the engine speed rises.

7. A lubricating oil supplying system for an internal combustion engine, as claimed in claim 1, wherein said electric pump operates when said driven pump fails to operate.

8. A lubricating oil supplying system as claimed in claim 1, wherein said bypass passage extends through a portion of said driven pump and connects said lubricating oil storage section and said discharge passage so as to allow lubricating oil to be sucked by said electric pump from said lubricating oil storage section to said discharge passage without first being sucked by said driven pump from said lubricating oil storage section, and wherein the check valve is disposed in said portion of said driven pump.

9. A lubricating oil supplying system for an internal combustion engine, as claimed in claim 1, further comprising a relief valve disposed in said bypass passage to allow the lubricating oil within the discharge passage to flow to a lower pressure side when the discharge pressure of the lubricating oil discharged from said driven pump to the discharge passage exceeds a predetermined level.

10. A lubricating oil supplying system for an internal combustion engine, as claimed in claim 9, further comprising a second bypass passage for bypassing said electric pump, and a bypass valve disposed in the second bypass passage and adapted to open in accordance with the pressure level in the discharge passage, wherein the bypass valve is adapted to open at a pressure level lower than the pressure level at which the relief valve opens.

11. A lubricating oil supplying system for an internal combustion engine, as claimed in claim 9, wherein the lubricating oil that flows out through the relief valve is returned into said lubricating oil storage section at the lower pressure side, and wherein said check valve is disposed inside the relief valve to allow the lubricating oil to flow only through a path from said lubricating oil storage section to the discharge passage.

12. A lubricating oil supplying system for an internal combustion engine, as claimed in claim 11, wherein the relief valve includes a plunger valve body having a pressure receiving section formed at one end of the plunger valve body, a section defining a lower pressure chamber formed at the other end of the plunger valve body to be in communication with said lubricating oil storage section, and a biasing member disposed in the lower pressure chamber to bias the plunger valve body in one direction, wherein a part of the lubricating oil acting on the pressure receiving section flows through the lower pressure chamber into said lubricating oil storage section when the plunger valve body moves against the biasing force of the biasing member, and wherein said check valve is disposed in the pressure receiving section of the relief valve.

13. A lubricating oil supplying system for an internal combustion engine, as claimed in claim 1, wherein the lubricating oil requiring section includes a main oil gallery for supplying the lubricating oil to sliding sections in the internal combustion engine, and a variable valve actuation mechanism operated by oil pressure, wherein said electric pump is driven by said controlling mechanism in accordance with an operating condition of the variable valve actuation mechanism.

14. A lubricating oil supplying system for an internal combustion engine, as claimed in claim 13, wherein the internal combustion engine is a multi-cylinder V-type engine having two banks of cylinders, each bank of cylinders having a variable valve actuation mechanism associated therewith.

15. A lubricating oil supplying system for an internal combustion engine, as claimed in claim 13, wherein the variable valve actuation mechanism is a variable valve lift mechanism.

16. A lubricating oil supplying system for an internal combustion engine, as claimed in claim 13, wherein the variable valve actuation mechanism is a valve timing controlling mechanism.

17. A lubricating oil supplying system as claimed in claim 1, wherein said driven pump comprises:

a pump mechanism for sucking lubricating oil from the storage section and discharging the lubricating oil to a discharge passage;

a plunger valve body having a pressure receiving section which is formed at one end of said plunger valve body and opens to the discharge passage, the plunger valve body being movable to release to a low pressure section a part of the lubricating oil discharged from said pump mechanism to the discharge passage;

a section defining a low pressure chamber formed at the other end of said plunger valve body and in communication with the low pressure section; and a biasing member disposed in the low pressure chamber to bias said plunger valve body in one direction, wherein the check valve is disposed in the pressure receiving section of said plunger valve body to allow the lubricating oil to flow through a path from said lower pressure chamber to the discharge passage.

18. A lubricating oil supplying system as claimed in claim 17, wherein said check valve includes a check ball for opening and closing a communicating hole formed in the pressure receiving section of said plunger valve body to communicate the low pressure chamber and the discharge passage, and a retainer fixed to the pressure receiving section of said plunger valve body to accommodate and retain the check ball therein.

19. A lubricating oil supplying system as claimed in claim 18, further comprising a second biasing member disposed within the retainer to bias the check ball in a direction to close the communicating hole.

20. A lubricating oil supplying system as claimed in claim 18, wherein the retainer is fixedly disposed within a valve hole formed in the pressure receiving section of said plunger valve body.

21. A fluid pump comprising:

a pump mechanism for sucking fluid from a storage section and discharging the fluid to a discharge section;

a section defining a bypass passage bypassing said pump mechanism so as to connect the storage section and the discharge section;

a plunger valve body movably disposed in said bypass passage and having a pressure receiving section which is formed at one end of said plunger valve body and opens to the discharge section, the plunger valve body being movable to release to a low pressure section a part of the fluid discharged from said pump mechanism to the discharge section;

a section defining a low pressure chamber formed at the other end of said plunger valve body and in communication with the low pressure section;

a biasing member disposed in the low pressure chamber to bias said plunger valve body in one direction; and a check valve disposed in the pressure receiving section of said plunger valve body to allow the fluid to flow through a path from said lower pressure chamber to the discharge section.

22. A fluid pump as claimed in claim 21, wherein said check valve includes a check ball for opening and closing a communicating hole formed in the pressure receiving section of said plunger valve body to communicate the low pressure chamber and the discharge section, and a retainer fixed to the pressure receiving section of said plunger valve body to accommodate and retain the check ball therein.

23. A fluid pump as claimed in claim 22, further comprising a second biasing member disposed within the retainer to bias the check ball in a direction to close the communicating hole.

24. A fluid pump as claimed in claim 22, wherein the retainer is fixedly disposed within a valve hole formed in the pressure receiving section of said plunger valve body.

25. A lubricating oil supplying system for an internal combustion engine, comprising:

a lubricating oil storage section for storing lubricating oil;

a first pump for sucking the lubricating oil from said lubricating oil storage section and discharging the lubricating oil to a discharge passage;

a second pump for sucking the lubricating oil discharged from said first pump to the discharge passage and discharging the lubricating oil to a lubricating oil requiring section in the internal combustion engine;

a bypass passage for bypassing said first pump; and an opening and closing mechanism disposed in said bypass passage to open said bypass passage when the amount of the lubricating oil discharged from said first pump exceeds that discharged from said second pump, and to cut off said bypass passage when the amount of the lubricating oil discharged from said first pump does not exceed the amount of the lubricating oil discharged from said second pump.

26. A fluid pump comprising:

a pump mechanism for sucking fluid from a storage section and discharging the fluid to a discharge section, which is connected to an electric pump for sucking the fluid discharged from said pump mechanism;

a section defining a bypass passage bypassing said pump mechanism so as to connect the storage section and the discharge section;

a plunger valve body movably disposed in said bypass passage and having a pressure receiving section which is formed at one end of said plunger valve body and opens to the discharge section, the plunger valve body being movable to release to a low pressure section a part of the fluid discharged from said pump mechanism to the discharge section;

a section defining a low pressure chamber formed at the other end of said plunger valve body and in communication with the low pressure section;

a biasing member disposed in the low pressure chamber to bias said plunger valve body in one direction; and a check valve disposed in the pressure receiving section of said plunger valve body to allow the fluid to flow through a path from said lower pressure chamber to the discharge section.

* * * * *